US009611571B2

(12) United States Patent
Ikenaka et al.

(10) Patent No.: US 9,611,571 B2
(45) Date of Patent: Apr. 4, 2017

(54) SHOE UPPER AND METHOD FOR PRODUCING SHOE UPPER

(71) Applicant: SHIMA SEIKI MFG., LTD., Wakayama-shi, Wakayama (JP)

(72) Inventors: Masamitsu Ikenaka, Wakayama (JP); Kenta Terai, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 0 days.

(21) Appl. No.: 14/913,441

(22) PCT Filed: Jul. 25, 2014

(86) PCT No.: PCT/JP2014/069763
§ 371 (c)(1),
(2) Date: Feb. 22, 2016

(87) PCT Pub. No.: WO2015/025678
PCT Pub. Date: Feb. 26, 2015

(65) Prior Publication Data

US 2016/0198798 A1 Jul. 14, 2016

(30) Foreign Application Priority Data

Aug. 23, 2013 (JP) ..... 2013-173924

(51) Int. Cl.
*D04B 1/22* (2006.01)
*A43B 23/02* (2006.01)
*A43B 1/04* (2006.01)

(52) U.S. Cl.
CPC ..... *D04B 1/22* (2013.01); *A43B 1/04* (2013.01); *A43B 23/024* (2013.01);
(Continued)

(58) Field of Classification Search
CPC ..... A43B 1/04; A43B 23/0205; A43B 23/024; A43B 23/0245; A43B 23/0265; D10B 25/043; D04B 1/22; D04B 1/24
See application file for complete search history.

(56) References Cited

U.S. PATENT DOCUMENTS 2,330,199 A * 9/1943 Basch ..... D04B 1/106 2/80
3,402,323 A * 9/1968 Longstreth ..... A43B 3/163 36/1

(Continued)

FOREIGN PATENT DOCUMENTS

JP 2007-236612 A 9/2007
WO 2012/125473 A2 9/2012

OTHER PUBLICATIONS

International Search Report cited in PCT/JP2014/069763 dated Oct. 28, 2014 (1 page).

*Primary Examiner* — Ted Kavanaugh
(74) *Attorney, Agent, or Firm* — Rothwell, Figg, Ernst & Manbeck, P.C.

(57) ABSTRACT

A shoe upper that suppresses a partial stretch of an upper main body with a means different from an inlay knitting yarn is provided. A shoe upper (100) including an upper main body (1) configured by a sole cover (2) and an instep cover (3) is provided, the shoe upper including a right side additional knitted fabric (4R) connected to a part of an edge portion (5*e*) of the shoe opening (5) in the instep cover (3) by knitting, which part is on a right side of a center line dividing the shoe opening (5) to right and left, and a left side additional knitted fabric (4L) connected to a part of the edge portion (5*e*) on a left side of the center line by knitting. The sole cover (2) and the instep cover (3) are integrally knitted in a seamless manner, and at least one part of the right side additional knitted fabric (4R) and at least one part of the left (Continued)

side additional knitted fabric (4L) are fixed to the upper main body (1), and the partial stretch of the upper main body (1) is suppressed by such additional knitted fabrics (4R, 4L).

3 Claims, 3 Drawing Sheets

(52) U.S. Cl.
CPC ..... *A43B 23/0205* (2013.01); *A43B 23/0245* (2013.01); *A43B 23/0265* (2013.01)

(56) References Cited

U.S. PATENT DOCUMENTS

| | | | | |
|---|---|---|---|---|
| 2008/0110048 | A1* | 5/2008 | Dua | A43B 1/04 36/45 |
| 2008/0110049 | A1* | 5/2008 | Sokolowski | A43B 3/0031 36/50.1 |
| 2010/0154256 | A1* | 6/2010 | Dua | A43B 1/04 36/25 R |
| 2010/0199406 | A1* | 8/2010 | Dua | A43B 1/04 2/115 |
| 2013/0239625 | A1* | 9/2013 | Meir | A43B 23/0245 66/170 |
| 2015/0107307 | A1* | 4/2015 | Kosui | D04B 1/22 66/177 |
| 2015/0143716 | A1* | 5/2015 | Long | A43B 1/04 36/83 |
| 2015/0173458 | A1* | 6/2015 | Ikenaka | A43B 1/04 36/45 |
| 2015/0374062 | A1* | 12/2015 | Ikenaka | A43B 1/04 12/142 G |
| 2016/0198797 | A1* | 7/2016 | Ikenaka | A43B 1/04 36/45 |

* cited by examiner

SHOE UPPER AND METHOD FOR PRODUCING SHOE UPPER

CROSS REFERENCE TO RELATED APPLICATION

This application is a 35 U.S.C. 371 National Phase Entry Application from PCT/JP2014/069763, filed Jul. 25, 2014, which claims the benefit of Japanese Patent Application No. JP 2013-173924 filed on Aug. 23, 2013, the disclosures of which are incorporated by reference in their entirety.

TECHNICAL FIELD

The present invention relates to a shoe upper, which is partially prevented from stretching, and a method for producing the shoe upper.

BACKGROUND ART

A shoe is produced by attaching an outer sole made of synthetic resin and the like to a shoe upper. When producing a shoe to be used indoors, the shoe is sometimes configured with only the shoe upper. The shoe upper includes an upper main body configured by a sole cover corresponding to a portion of a sole of a wearer and an instep cover corresponding to a portion on an instep side of the wearer, and is configured by attaching a shoelace, a reinforcement material and the like to such upper main body.

In recent years, attempts have been made to configure the instep cover, of the instep cover and the sole cover configuring the upper main body (shoe upper), with one knitted fabric. For example, in Patent Document 1, the instep cover in a planarly developed state is produced with one knitted fabric, and such instep cover is joined to the outer sole made of synthetic resin, and the like along with the sole cover to complete the shoe.

Furthermore, in Patent Document 1 described above, an inlay knitting yarn is interwoven into the side surface portion of the upper main body to suppress the stretch of the portion where the inlay knitting yarn is interwoven. The inlay knitting yarn is a knitting yarn arranged to thread its way between the stitches lined in a knitting width direction of the knitted fabric, and has an effect of suppressing the stretch in the knitting width direction of the knitted fabric and an effect of reinforcing the knitted fabric. Thus, the shape stability and the fitting property of the shoe upper can be ensured while exhibiting the properties of knits by making a part of the upper main body less likely to stretch with the inlay knitting yarn.

PRIOR ART REFERENCES

Patent Documents

[Patent Document 1] International Patent Publication No. 2012/125473

DISCLOSURE OF THE INVENTION

Problems to be Solved by the Invention

However, when using the inlay knitting yarn to partially prevent the stretch of the upper main body (shoe upper), a location where the stretch can be suppressed in the upper main body is limited. The inlay knitting yarn is arranged to thread its way between the stitches lined in the knitting width direction of the knitted fabric, and disperses the tension of the knitted fabric when the knitted fabric is pulled in the knitting width direction so that the stretch of the knitted fabric is suppressed. Thus, although the effect of suppressing the stretch in the knitting width direction of the knitted fabric by the inlay knitting yarn is high, the effect of suppressing the stretch in the direction intersecting the knitting width direction is low, and the location where the stretch can be partially suppressed in the upper main body is limited.

The present invention has been made in light of the foregoing, and an object of the present invention is to provide a shoe upper in which a partial stretch of the upper main body is suppressed with a means different from the inlay knitting yarn. Another object of the present invention is to provide a method for producing the shoe upper for producing the shoe upper described above.

Means for Solving the Problems

An aspect of the present invention relates to a shoe upper including an upper main body configured by a sole cover corresponding to a portion of a sole of a wearer, and an instep cover corresponding to a portion on an instep side of the wearer. The shoe upper of the present invention includes aright side additional knitted fabric which is connected to apart of an edge portion of a shoe opening in the instep cover by knitting, which part is on a right side of a center line dividing the shoe opening to right and left; and a left side additional knitted fabric which is connected to a part of the edge portion on a left side of the center line by knitting. In the shoe upper of the present invention, the sole cover and the instep cover are integrally knitted in a seamless manner; and at least one part of the right side additional knitted fabric and at least one part of the left side additional knitted fabric are fixed to the upper main body, and a partial stretch of the upper main body is suppressed by the additional knitted fabrics.

According to one aspect of the shoe upper of the present invention, the right side additional knitted fabric and the left side additional knitted fabric are turned back toward an outer side direction or an inner side direction of the upper main body at a position of the edge portion.

According to one aspect of the shoe upper of the present invention, the right side additional knitted fabric and the left side additional knitted fabric are connected.

An aspect of the present invention relates to a method for producing a shoe upper for producing a shoe upper of the present invention. In the method for producing the shoe upper of the present invention, an upper main body configured by a sole cover and an instep cover is knitted in a seamless manner, using a flat knitting machine including at least a pair of a front and aback needle bed; and a right side additional knitted fabric and a left side additional knitted fabric connected to an edge portion of a shoe opening in the instep cover are knitted in a seamless manner, to produce a semi-finished shoe upper (hereinafter referred to as SFSU). In the method for producing the shoe upper of the present invention, at least one part of the right side additional knitted fabric and at least one part of the left side additional knitted fabric in the SFSU are fixed to the upper main body.

According to one aspect of the method for producing the shoe upper of the present invention, knitting is carried out in the following manner when producing the SFSU.

When knitting the SFSU from a sole side toward an instep side, the sole cover is knitted, and thereafter, the instep cover is knitted, and the right side additional knitted fabric and the left side additional knitted fabric are knitted following one part of a terminating end in a wale direction of the instep cover.

When knitting the SFSU from the instep side toward the sole side, the right side additional knitted fabric and the left side additional knitted fabric are knitted, and thereafter, the instep cover is knitted following a terminating end in a wale direction of the additional knitted fabrics, and the sole cover is knitted.

According to one aspect of the method for producing the shoe upper of the present invention, knitting is carried out in the following manner when producing the SFSU.

When knitting the SFSU from a heel side toward a toe side, while integrally knitting the sole cover and the instep cover to complete the upper main body, the right side additional knitted fabric and the left side additional knitted fabric are knitted independent from the instep cover and the sole cover, and a terminating end in a wale direction of the right side additional knitted fabric and the left side additional knitted fabric is connected to a position corresponding to the edge portion of the shoe opening in the instep cover.

When knitting the SFSU from the toe side toward the heel side, while integrally knitting the sole cover and the instep cover to complete the upper main body, the right side additional knitted fabric and the left side additional knitted fabric are branched from the position corresponding to the edge portion of the shoe opening in the instep cover.

Effect of the Invention

In the shoe upper of the present invention, the partial stretch of the upper main body is suppressed by the right and left additional knitted fabrics without using the inlay knitting yarn. As the portion where the stretch is suppressed in the upper main body suppresses the excessive stretch of the entire upper main body, the shoe upper of the present invention is less likely to lose shape, and can be easily fitted to the foot of the wearer. The right and left additional knitted fabrics arranged in the shoe upper of the present invention have an effect of reinforcing the upper main body, and thus the shoe upper of the present invention excels in durability.

The right and left additional knitted fabrics are turned back toward the outer side direction or the inner side direction of the upper main body at the position of the edge portion of the shoe opening and fixed, thus reinforcing a foot insertion opening to where the wearer inserts the foot. If the additional knitted fabrics are turned back toward the outer side direction of the upper main body and fixed thereat, the shoe upper can excel in design by providing designability to the additional knitted fabrics. Furthermore, if the additional knitted fabrics are turned back toward the inner side direction of the upper main body and fixed thereat, the turned-back portion of the additional knitted fabrics cannot be seen from the outer side of the shoe upper. If the right and left additional knitted fabrics are connected, reinforcement can be provided in a wider range of the upper main body, in particular, over the entire periphery of the connected right and left additional knitted fabrics.

Compared to when the inlay knitting yarn is used, the degree of freedom of a location where the partial stretch of the upper main body can be suppressed in the shoe upper of the present invention is wide. This is because, in producing the shoe upper of the present invention, the right and left additional knitted fabrics that suppress the partial stretch of the upper main body are knitted independent from the upper main body, and fixed to the upper main body after the upper main body is knitted.

The present invention does not deny the use of the inlay knitting yarn, and a location where the inlay knitting yarn is used may exist in the shoe upper of the present invention.

MODE FOR CARRYING OUT THE INVENTION

Hereinafter, embodiments of a shoe upper and a method for producing the same of the present invention will be described based on the drawings. The embodiments shown below are of course merely examples, and the present invention is not limited to the configurations of the embodiments.

<First Embodiment>

<<Overall Configuration>>

Figure 1:
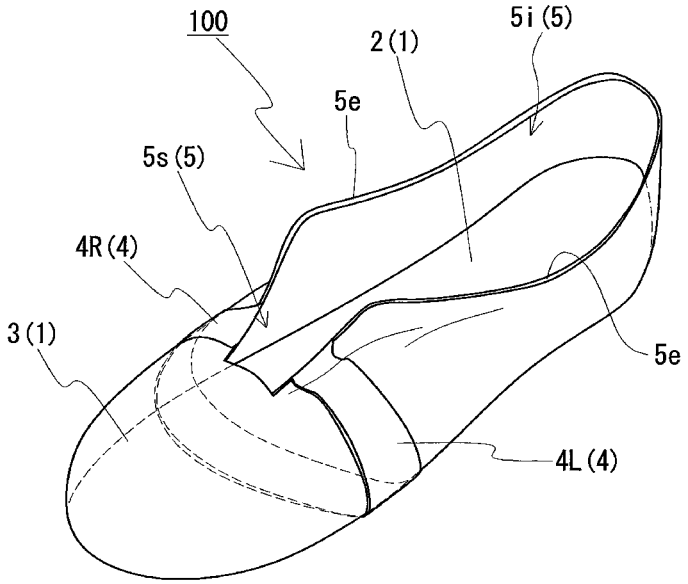
FIG. 1 is a schematic perspective view of a shoe upper shown in a first embodiment.

A shoe upper 100 shown in FIG. 1 includes an upper main body 1 configured by a sole cover 2 corresponding to a portion of a sole of a wearer and an instep cover 3 corresponding to a portion on an instep side of the foot of the wearer. The shoe upper 100 may be used as it is as a shoe, or an outer sole (not shown) made of resin and the like may be attached to the outer side of the sole cover 2 of the shoe upper 100 to form the shoe. The main configuration of the shoe upper 100 that differs from the conventional shoe upper includes the following two points.

[1] The upper main body 1 configured by the instep cover 3 and the sole cover 2 is integrally knitted in a seamless manner.

[2] Aright side additional knitted fabric 4R and a left side additional knitted fabric 4L connected by knitting to an edge portion 5*e* of a shoe opening 5 in the instep cover 3 are provided, which additional knitted fabrics 4R, 4L suppress the partial stretch of the upper main body 1.

Each configuration of the shoe upper 100 will be described in detail below.

<<Upper Main Body>>

The shoe opening 5 is formed on the upper side of the instep cover 3 configuring the upper main body 1. The shoe opening 5 of the present example includes a foot insertion opening 5*i*, to which the wearer inserts the foot, and a slit 5*s* extending from the foot insertion opening 5*i* toward the toe side. An eyelet hole, through which the shoelace is passed, may be formed at the position of the slit 5*s* in the instep cover 3.

The sole cover 2 configuring the upper main body 1 is the portion that becomes the shoe sole when the shoe upper 100 is used as it is as the shoe. When attaching the outer sole to the outer side of the sole cover 2, the sole cover 2 functions as an insole of the shoe. In either form, the sole cover 2 covers the entire surface of the sole of the wearer.

The sole cover 2 and the instep cover 3 are preferably knitted with a fusible knitting yarn including a heat fusible yarn. With the use of the fusible knitting yarn, the shoe upper 100 can be shaped to a three-dimensional shape when the shoe upper 100 is fitted to a last (foot model) and performed with thermal processing. The sole cover 2 and the instep cover 3 may, of course, be knitted with a non-fusible knitting yarn that does not include the heat fusible yarn, or a part of the sole cover 2 and the instep cover 3 may be knitted with the fusible knitting yarn and the remaining part may be knitted with the non-fusible knitting yarn. For example, the toe, the heel, the part slightly on the heel side of the base of the toe and the like may be knitted with the fusible knitting yarn, and the remaining part may be knitted with the non-fusible knitting yarn.

<<Right Side Additional Knitted Fabric and Left Side Additional Knitted Fabric>>

The right side additional knitted fabric 4R (left side additional knitted fabric 4L) is connected to a part of the edge portion 5*e* of the shoe opening 5 in the instep cover 3 by knitting, which part is on the right side (left side) of a center line dividing the shoe opening 5 to the right and left. In the present example, the additional knitted fabrics 4R, 4L are annularly connected to form a belt-form knitted fabric 4, which belt-form knitted fabric 4 is wound around the outer periphery of the upper main body 1. Specifically, a connecting location with the edge portion 5*e* in the additional knitted fabrics 4R, 4L configuring the belt-form knitted fabric 4 is turned back toward the outer side direction of the upper main body 1 at the position of the edge portion 5*e*, and the belt-form knitted fabric 4 is hooked to the sole cover 2.

As opposed to the illustration of FIG. 1, the connecting location with the edge portion 5*e* in the additional knitted fabrics 4R, 4L may be turned back toward the inner side direction of the upper main body 1 at the position of the edge portion 5*e*, so that the belt-form knitted fabric 4 lies along the inner peripheral surface of the upper main body 1. Furthermore, the additional knitted fabrics 4R, 4L may be independent without being connected, as shown in a third embodiment, to be described later.

At least one part of the additional knitted fabrics 4R, 4L is fixed to an arbitrary location of the upper main body 1 (may be anywhere in the instep cover 3, or anywhere in the sole cover 2), so that the function of suppressing the partial stretch of the upper main body 1 is exhibited. The effect of suppressing the stretch is exhibited from a connecting end with the edge portion 5*e* in the right side additional knitted fabric 4R (left side additional knitted fabric 4L) to the fixing location with the upper main body 1. Therefore, the region the stretch of the upper main body 1 can be suppressed becomes larger if the fixing location is at a position away from the connecting end. Of course, the entire right side additional knitted fabric 4R (left side additional knitted fabric 4L) maybe fixed to the upper main body 1, in which case, the stretch of the entire portion where the right side additional knitted fabric 4R (left side additional knitted fabric 4L) is overlapped with the upper main body 1 is suppressed. Furthermore, in this case, the stretch of the upper main body 1 in not only the extending direction of the right side additional knitted fabric 4R (left side additional knitted fabric 4L) but also in the direction intersecting the extending direction can be suppressed. This is an effect not obtainable with the inlay knitting yarn that suppresses the stretch in the knitting width direction of the knitted fabric.

The method for fixing the additional knitted fabrics 4R, 4L to the upper main body 1 is not particularly limited. For example, sewing may be used or adhesive may be used. At least one of the upper main body 1 or the additional knitted fabric 4R, 4L may be knitted with the fusible knitting yarn, and the additional knitted fabrics 4R, 4L may be fixed to the upper main body 1 by fusion. Alternatively, when joining the outer sole to the sole cover 2 of the shoe upper 100, the additional knitted fabrics 4R, 4L may be fixed to the upper main body 1 by sandwiching the additional knitted fabrics 4R, 4L between the sole cover 2 and the outer sole.

The width and the length of the additional knitted fabric 4R, 4L may be appropriately selected according to the range of suppressing the stretch, and are not particularly limited. For example, when winding the belt-form knitted fabric 4 (additional knitted fabric 4R, 4L) on the sole cover 2 side, as shown in FIG. 1, the belt-form knitted fabric 4 may be formed to a length corresponding to the peripheral length of the upper main body 1.

A plurality of the additional knitted fabrics 4R, 4L may be arranged respectively. This is similar in the second and third embodiments described below.

<<Method for Producing Shoe Upper>>

In order to produce the shoe upper 100, a semi-finished shoe upper (hereinafter referred to as SFSU) is first knitted (knitting process). The SFSU includes, similar to the shoe upper 100, the upper main body 1 configured by the instep cover 3 and the sole cover 2, and the additional knitted fabrics 4R, 4L. However, the additional knitted fabrics 4R, 4L in the SFSU merely have one end side connected to the edge portion 5*e* of the shoe opening 5, and the other portions are not connected nor fixed to the upper main body 1. Thus, when producing the shoe upper 100 shown in FIG. 1 from the SFSU, at least one part of the additional knitted fabrics 4R, 4L is to be fixed to the upper main body 1 (fixing process). First, the knitting process will be described while referencing FIGS. 2 to 5, and thereafter, the fixing process will be described.

[Knitting Process]

A two-bed flat knitting machine including at least a pair of a front and a back needle bed and in which stitches can be transferred between the front and back needle beds can be used for the knitting of the SFSU in the embodiments. The flat knitting machine to be used may, of course, be a four-bed flat knitting machine.

The method for knitting the SFSU is roughly divided to a knitting method I in which the knitting advances in a height direction (sole side→instep side, or instep side→sole side) of the SFSU, and a knitting method II in which the knitting advances in a length direction (heel side→toe side, or toe side→heel side) of the SFSU. Knitting methods I-A, I-B, and I-C will be sequentially described for the former example, and knitting methods II-A, II-B, and II-C will be sequentially described for the latter example.

One of FIGS. 2 to 5 is used for the description of each knitting method. In FIGS. 2 to 5, one needle bed (front needle bed or back needle bed) of the flat knitting machine is arranged on a near side in the plane of drawing, and the other needle bed (back needle bed or front needle bed) of the flat knitting machine is arranged on a far side in the plane of drawing, where knitting is carried out with the right side portion of the SFSU 10 attached to one needle bed and the left side portion attached to the other needle bed. In addition, description will be made assuming the right side portion and the left side portion of the sole cover 2 as a sole right portion 2R and a sole left portion 2L, respectively, and the right side portion and the left side portion of the instep cover 3 as a main body right portion 3R and a main body left portion 3L, respectively. In FIGS. 2 to 5 used in the description, a location where the right side portion and the left side portion are connected is shown with hatching, a boundary line of the sole cover 2 and the instep cover 3 is shown with a chain dashed line, and upper case alphabets are denoted on important areas of the knitting.

(Knitting Method I-A; Sole Side→Instep Side)

The knitting method I-A will be described based on FIG. 2. The knitting method I-A is a method of knitting from the sole side (upper side in the plane of drawing) toward the instep side (lower side in the plane of drawing) of the SFSU 10, where following processes α, β, γ are sequentially carried out.

—Process α

In the process α, the sole right portion 2R is knitted using one needle bed of the flat knitting machine, and the sole left portion 2L is knitted using the other needle bed of the flat knitting machine. For example, a knitting yarn is fed to one needle bed and the other needle bed alternately to form a set up portion (curved line connecting point A and point B), the sole right portion 2R is knitted following a wale direction of a stitch row held on one needle bed of the set up portion, and the sole left portion 2L is knitted following a wale direction of a stitch row held on the other needle bed. Upon knitting, the flechage knitting and the C-shaped knitting are used selectively to knit the sole cover 2 having a shape that corresponds to the sole shape of the wearer.

—Process β

In the process β, the main body right portion 3R is knitted following a terminating end in a wale direction (chain dashed line) of the sole right portion 2R using one needle bed, and the main body left portion 3L is knitted following a terminating end in a wale direction of the sole left portion 2L using the other needle bed. Upon knitting, the flechage knitting, the C-shaped knitting, and the tubular knitting are used selectively according to the three-dimensional shape of the foot of the wearer to complete the instep cover 3 in which the main body right portion 3R and the main body left portion 3L are connected at the position of the toe and the position of the heel. The shoe opening 5 is formed by performing a bind-off process on one part (point D-point E) of the terminating end in the wale direction of the portions 3R, 3L.

—Process γ

In the process γ, the right side additional knitted fabric 4R is knitted following one part (point C-point D) of the terminating end in the wale direction of the main body right portion 3R using one needle bed, and the left side additional knitted fabric 4L is knitted following one part (point C-point D) of the terminating end in the wale direction of the main body left portion 3L using the other needle bed. As shown in FIG. 1, when connecting the additional knitted fabrics 4R, 4L to a belt form, the terminating ends (point F-point G) in the wale direction of the additional knitted fabrics 4R, 4L are connected with the bind-off process and the like. If the additional knitted fabrics 4R, 4L are not connected to a belt form, the terminating ends (point F-point G) in the wale direction of the additional knitted fabric 4R, 4L are preferably performed with the bind-off process, respectively.

(Knitting Method I-B; Instep Side→Sole Side)

The knitting method I-B will be described based on FIG. 2. The knitting method I-B is a method of knitting from the instep side (lower side in the plane of drawing) toward the sole side (upper side in the plane of drawing) of the SFSU 10, where following processes δ, ϵ, ζ are sequentially carried out.

—Process δ

In the process δ, the right side additional knitted fabric 4R is knitted using one needle bed of the flat knitting machine, and the left side additional knitted fabric 4L is knitted using the other needle bed of the flat knitting machine. For example, a knitting yarn is fed to one needle bed and the other needle bed alternately to form a set up portion (point F-point G), the right side additional knitted fabric 4R is knitted following a wale direction of a stitch row held on one needle bed of the set up portion, and the left side additional knitted fabric 4L is knitted following a wale direction of a stitch row held on the other needle bed.

—Process ϵ

In the process ϵ, the main body right portion 3R is knitted following the terminating end (point C-point D) in the wale direction of the right side additional knitted fabric 4R using one needle bed, and the main body left portion 3L is knitted following the end (point C-point D) in the wale direction of the left side additional knitted fabric 4L using the other needle bed. A line of point D-point E to become the shoe opening 5 may be formed by set up.

—Process ζ

In the process ζ, the sole right portion 2R is knitted following the terminating end (chain dashed line) in the wale direction of the main body right portion 3R using one needle bed, and the sole left portion 2L is knitted following the terminating end (chain dashed line) in the wale direction of the main body left portion 3L using the other needle bed. Lastly, the sole right portion 2R and the sole left portion 2L are connected at a central line (curved line connecting point A and point B) extending in the length direction of the sole cover 2 to complete the SFSU 10. The method of connecting the sole right portion 2R and the sole left portion 2L is not particularly limited, and for example, a known bind-off process can be used. Alternatively, the sole right portion 2R and the sole left portion 2L may be connected by the front and back knits that alternately knit stitches on the one needle bed and the other needle bed. Use of the front and back knits that do not require transfer can connect the sole right portion 2R and the sole left portion 2L in an extremely shorter time compared to the bind-off process that requires transfer. A connecting portion is at a position that is not visible when the shoe upper 100 is worn, and thus the appearance of the shoe upper 100 is not impaired by the connecting portion.

(Knitting Method I-C)

In the knitting method I-C, a knitting example in which the knitting direction of the additional knitted fabrics 4R, 4L differs from the knitting methods I-A, I-B will be described based on FIG. 3.

Here, an example of knitting in the order of additional knitted fabrics 4R, 4L→instep cover 3→sole cover 2 (example of knitting each portion in the same order as knitting method I-B) will now be described. In this case, an independent set up portion (point A-point B) is first knitted on one needle bed and the other needle bed. The right side additional knitted fabric 4R is knitted following the wale direction of the set up portion of one needle bed, and the left side additional knitted fabric 4L is knitted following the wale direction of the set up portion of the other needle bed (corresponding to process δ of knitting method I-B). In this case, the C-shaped knitting is carried out so that the additional knitted fabrics 4R, 4L are connected on the heel side of the upper main body 1.

Then, the instep cover 3 and the sole cover 2 are knitted following the terminating end (point A-point C-point D (point E)) in the wale direction of the additional knitted fabrics 4R, 4L. The manner of knitting the instep cover 3 and the sole cover 2 is the same as the process ϵ and the process ζ of the knitting method I-B. In the example shown in FIG. 3, a draw thread (see zigzag line) is provided at the terminating end in the wale direction of the additional knitted fabrics 4R, 4L to facilitate the knitting of the instep cover 3, and the instep cover 3 is knitted following the draw thread. The additional knitted fabrics 4R, 4L are separated from the instep cover 3 and formed to a belt form by removing the draw thread after the knitting of the additional knitted fabrics 4R, 4L. However, the draw thread is not essential.

Figure 3:
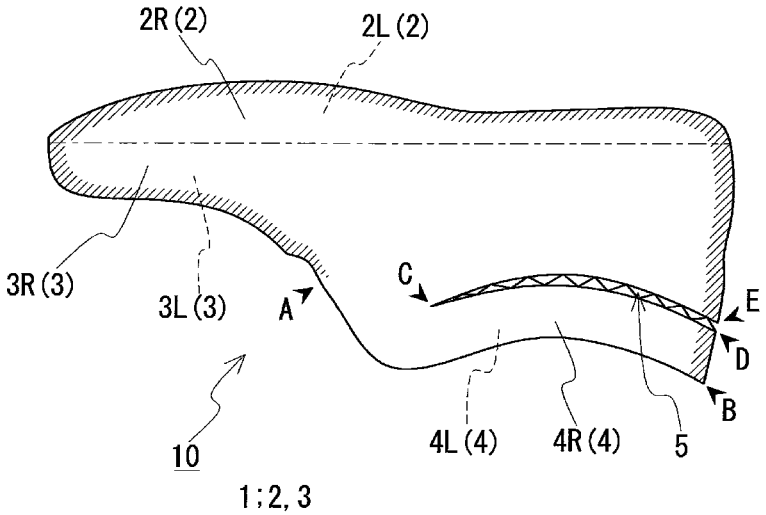
FIG. 3 is a schematic view showing one example of a method for knitting the semi-finished shoe upper shown in the first embodiment.

Similar to the knitting method I-A, the SFSU 10 shown in FIG. 3 may be knitted in the order of sole cover 2→instep cover 3→additional knitted fabrics 4R, 4L.

(Knitting Method II-A; Heel Side→Toe Side)

The knitting method II-A will be described with reference to FIG. 4. The knitting method II-A is a method of knitting from the heel side (lower side in the plane of drawing) toward the toe side (upper side in the plane of drawing) of the SFSU 10, where process η and process θ, described below, are carried out, and then process ι, described below, is carried out. Either process η or process θ may be carried out first or the processes may be carried out simultaneously.

—Process η

In the process η, the sole right portion 2R and the main body right portion 3R are knitted using one needle bed of the flat knitting machine and the sole left portion 2L and the main body left portion 3L are knitted using the other needle bed of the flat knitting machine up to the connecting position (position of the tip of arrow extending from point F) of the instep cover 3, and the right side additional knitted fabric 4R and the left side additional knitted fabric 4L. For example, a set up portion (point A-point B) crossing the one needle bed and the other needle bed may be knitted, and each portion 2R, 2L, 3R, 3L may be knitted following the wale direction of such set up portion. The sole right portion 2R and the sole left portion 2L are in a connected state using the C-shaped knitting and the like.

—Process θ

In the process θ, the right side additional knitted fabric 4R is knitted using one needle bed, and the left side additional knitted fabric 4L is knitted using the other needle bed. When connecting the additional knitted fabrics 4R, 4L to a belt form, the set up portion (point C-point D) crossing the one needle bed and the other needle bed is to be knitted. When not connecting the additional knitted fabrics 4R, 4L to a belt form, an independent set up portion (point C-point D) is to be knitted on the one needle bed and the other needle bed respectively. In either case, the additional knitted fabrics 4R, 4L are independently knitted.

—Process ι

In the process ι, the sole right portion 2R and the main body right portion 3R are knitted using one needle bed, and the sole left portion 2L and the main body left portion 3L are knitted using the other needle bed up to the position of the toe. In this case, the end (point F-point E) in the wale direction of the right side additional knitted fabric 4R is connected to the main body right portion 3R by knitting, and the end (point F-point E) in the wale direction of the left side additional knitted fabric 4L is connected to the main body left portion 3L by knitting. For example, overlapping of the stitches at the end in the wale direction of the right side additional knitted fabric 4R (left side additional knitted fabric 4L) with the stitches at the end in the knitting width direction of the main body right portion 3R (main body left portion 3L), and knitting of the main body right portion 3R (main body left portion 3L) are repeated to connect the additional knitted fabrics 4R, 4L to the instep cover 3.

The manner of closing the toe of the upper main body 1 is not particularly limited. For example, the stitches held on the one needle bed and the other needle bed are connected by the bind-off process and the like, so that a knitting end portion (point G-point H) is formed in the height direction of the upper main body 1. Alternatively, the knitting end portion may be formed in the width direction (depth direction in the plane of drawing) of the upper main body 1.

(Knitting Method II-B; Toe Side→Heel Side)

The knitting method II-B will also be described with reference to FIG. 4. The knitting method II-B is a method of knitting from the toe side (upper side in the plane of drawing) toward the heel side (lower side in the plane of drawing) of the SFSU 10, where processes κ, λ, described below, are carried out, and then process μ and process ν, described below, are carried out. Either process μ or process ν may be carried out first, or the processes may be carried out simultaneously.

—Process κ

In the process κ, the sole right portion 2R and the main body right portion 3R are knitted using one needle bed of the flat knitting machine, and the sole left portion 2L and the main body left portion 3L are knitted using the other needle bed of the flat knitting machine up to the connecting position (position of the tip of arrow extending from point E) of the instep cover 3, and the right side additional knitted fabric 4R and the left side additional knitted fabric 4L. For example, a knitting yarn is fed to the one needle bed and the other needle bed alternately to knit the set up portion (point G-point H) on the toe side, and each portion 2R, 2L, 3R, 3L is knitted following the wale direction of the set up portion.

—Process λ

In the process λ, a starting point of the right side additional knitted fabric 4R is formed at the end in the knitting width direction of the main body right portion 3R while knitting the sole right portion 2R and the main body right portion 3R using one needle bed, and a starting point of the left side additional knitted fabric 4L is formed at the end in the knitting width direction of the main body left portion 3L while knitting the sole left portion 2L and the main body left portion 3L using the other needle bed. The starting point (portion indicated by the tip of arrow extending from the additional knitted fabric 4R, 4L) can, for example, be formed by forming widening stitch and the like at the end in the knitting width direction of the main body right portion 3R (main body left portion 3L) and leaving the stitch on the needle bed.

—Process μ

Figure 4:
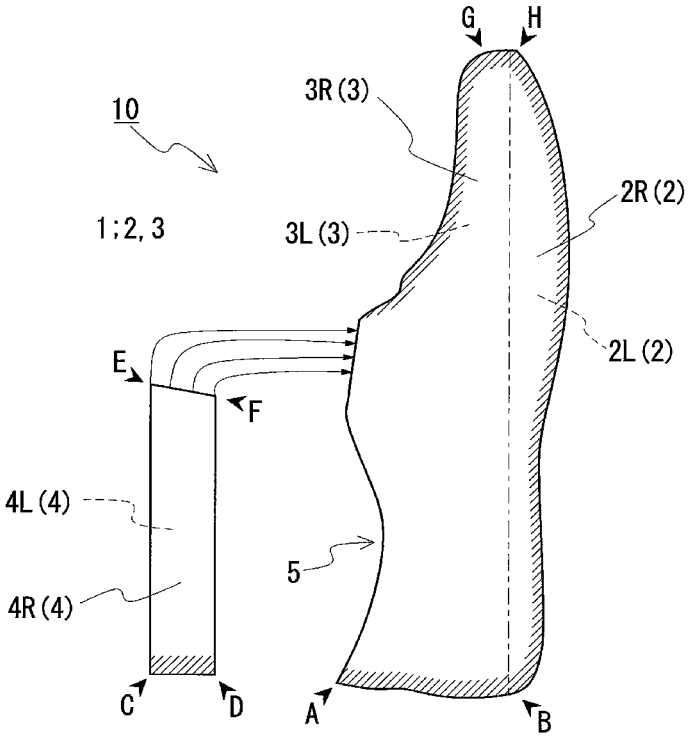
FIG. 4 is a schematic view showing one example of a method for knitting the semi-finished shoe upper shown in the first embodiment.
Figure 5:
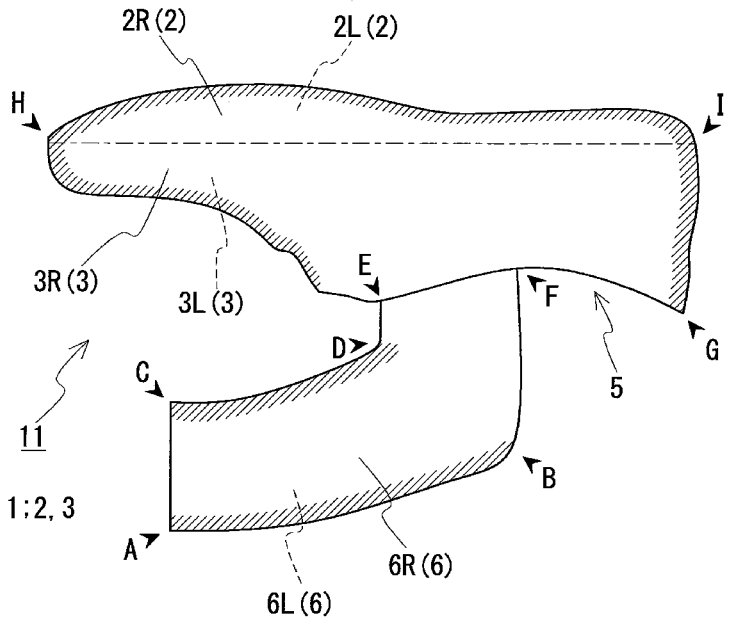
FIG. 5 is a schematic view showing one example of a method for knitting a semi-finished shoe upper shown in a second embodiment.

In the process μ, the right side additional knitted fabric 4R is knitted using one needle bed based on the starting point formed on the one needle bed, and the left side additional knitted fabric 4L is knitted using the other needle bed based on the starting point formed on the other needle bed (image of knitting in the direction opposite to the arrow of FIG. 4). The ends in the wale direction (point C-point D) of the additional knitted fabrics 4R, 4L are then connected to complete the belt-form knitted fabric 4. When not connecting the additional knitted fabrics 4R, 4L, the additional knitted fabrics 4R, 4L are individually performed with the bind-off process.

—Process ν

In the process ν, the sole right portion 2R and the main body right portion 3R are knitted using one needle bed and the sole left portion 2L and the main body left portion 3L are knitted using the other needle bed up to the position (point A-point B) of the heel. The bind-off process can be used to connect the right side portion and the left side portion of the heel.

(Knitting Method II-C)

In the knitting methods II-A, II-B, the knitting width direction of the additional knitted fabrics 4R, 4L shown in FIG. 4 is the direction of point C-point D (direction of point E-point F). On the contrary, in the knitting method II-C, an example of knitting the SFSU in which the knitting width direction of the additional knitted fabrics 4R, 4L is the direction of point D-point F (direction of point C-point E) will be described. Reference is made to FIG. 2 to easily understand the knitting method II-C. Therefore, in the following description, description will be made with reference to FIG. 2.

Figure 2:
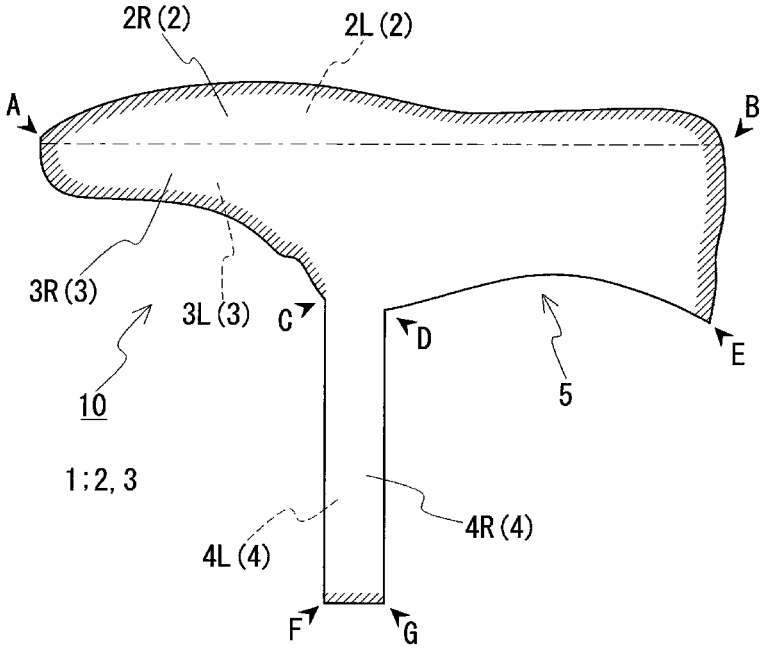
FIG. 2 is a schematic view showing one example of a method for knitting a semi-finished shoe upper shown in the first embodiment.

In the knitting method II-C, the set up portion (point E-point B) corresponding to the heel of the upper main body 1 is knitted and the knitting is carried out from the heel side (right side in the plane of drawing) toward the toe side (left side in the plane of drawing) of the FIG. 2 based on the set up portion, or the set up portion (near point A) corresponding to the toe of the upper main body 1 is knitted and the knitting is carried out from the toe side toward the heel side based on the set up portion. As the knitting advances up to the connecting position of the instep cover 3, and the right side additional knitted fabric 4R and the left side additional knitted fabric 4L, the knitting is then carried out with the right side additional knitted fabric 4R (left side additional knitted fabric 4L) arranged side by side to the end (point C-point D) in the knitting width direction of the main body right portion 3R (main body left portion 3L).

[Fixing Process]

After producing the SFSU 10 with one of the knitting methods described above, the additional knitted fabrics 4R, 4L are bent toward the outer side direction of the upper main body 1 at the position of the edge portion 5*e* (FIG. 1) to obtain a state in which the belt-form knitted fabric 4 is wound around the sole cover 2. The additional knitted fabrics 4R, 4L are then fixed to the upper main body 1. As already described earlier, sewing, adhesion, heat fusion and the like can be used for the fixing method. Furthermore, the fixing position is not particularly limited as already described above.

When arranging the belt-form knitted fabric 4 inside the upper main body 1, the additional knitted fabrics 4R, 4L are bent toward the inward direction of the upper main body 1 at the position of the edge portion 5*e* to obtain a state in which the belt-form knitted fabric 4 is arranged to lie along the inner peripheral surface of the upper main body 1.

<Second Embodiment>

In a second embodiment, a shoe upper including a tubular reinforced knitted fabric formed by connecting one part of the left side additional knitted fabric and one part of the right side additional knitted fabric will be described. Upon making the description, the knitting method of a SFSU 11, which becomes the basis of the shoe upper of the second embodiment, will be described first based on FIG. 5. In the second embodiment, an example of knitting the SFSU 11 from the instep side (lower side in the plane of drawing) toward the sole side (upper side in the plane of drawing) of the upper main body 1 will be described, but this may be reversed.

Similar to the knitting method I-B of the first embodiment, the SFSU 11 is obtained by knitting in the order of additional knitted fabrics 6R, 6L→instep cover 3→sole cover 2. For example, the set up portion (point A-point B) crossing the front and back needle beds is knitted, and the right side additional knitted fabric 6R and the left side additional knitted fabric 6L are knitted following the relevant set up portion. In this case, the knitting width of the additional knitted fabrics 6R, 6L is appropriately increased/decreased so as to have a shape that lies along one part of the internal shape of the upper main body 1. Furthermore, the bind-off process of connecting the additional knitted fabrics 6R, 6L is carried out at the position of point C-point D. A reinforced knitted fabric 6 having a tube portion in which one part of the right side additional knitted fabric 6R and one part of the left side additional knitted fabric 6L are connected to a tubular shape is thereby knitted. The reinforced knitted fabric 6 has a shape that lies along one part of the internal shape of the upper main body 1 as a whole, where the tube portion of the reinforced knitted fabric 6 has the opening directed in a length direction of the upper main body 1. A wider range of the upper main body 1 can be reinforced (prevented from stretching) over the entire periphery of the tube portion with the reinforced knitted fabric 6 compared to the first embodiment.

After the knitting of the reinforced knitted fabric 6 is finished, the set up portion (point F-point G) crossing the front and back needle beds is knitted, and the main body right portion 3R is knitted following the set up portion and the end (point E-point F) in the wale direction of the right side additional knitted fabric 6R, and the main body left portion 3L is knitted following the set up portion (point F-point G) and the end (point E-point F) in the wale direction of the left side additional knitted fabric 6L (similar to process ϵ of knitting method I-B). Furthermore, similar to the process ζ of the knitting method I-B, the sole cover 2 is completed following the end (point H-point I) in the wale direction of the main body right portion 3R and the main body left portion 3L.

After the SFSU 11 is knitted, the reinforced knitted fabric 6 is folded to the interior of the upper main body 1 so as to be arranged to lie along the inner peripheral surface of the upper main body 1. The reinforced knitted fabric 6 is then fixed to the upper main body 1 to complete the shoe upper. The fixing can be easily carried out through the use of heat fusion.

According to the shoe upper of the second embodiment described above, the stretch of the upper main body 1 in the vicinity of the base of the toe can be effectively suppressed, and hence the fitting property of the shoe upper with respect to the foot can be enhanced.

<Third Embodiment>

In a third embodiment, a shoe upper 102 having a configuration different from the first and second embodiments will be described based on FIG. 6.

Figure 6:
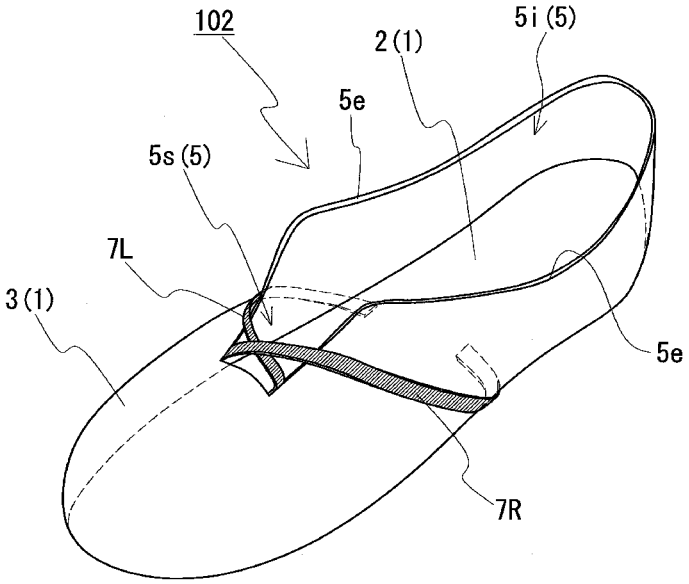
FIG. 6 is a schematic perspective view of a shoe upper shown in a third embodiment.

Additional knitted fabrics 7R, 7L of the shoe upper 102 shown in FIG. 6 are not connected to a belt form, and are intersected at the position of the slit 5*s*. The right side additional knitted fabric 7R is fixed to the left side portion of the upper main body 1, and the left side additional knitted fabric 7L is fixed to the right side portion of the upper main body 1. The additional knitted fabrics 7R, 7L in such fixed state have an effect of suppressing the spacing of the slit 5*s* from opening in excess, in addition to the effect of suppressing the partial stretch of the upper main body 1. Furthermore, if an elastic knitting yarn is used for the additional knitted fabrics 7R, 7L, the shoe upper 102, which is easy to wear since the additional knitted fabrics 7R, 7L stretch when wearing and which is less likely to come off since the additional knitted fabrics 7R, 7L contract after wearing, can be obtained.

The SFSU that becomes the basis of the shoe upper 102 can also be knitted through any knitting method described in the first embodiment. The additional knitted fabrics 7R, 7L may be obtained by knitting in a non-connected state or may be obtained by cutting the knitted fabric connected to a belt form.

DESCRIPTION OF SYMBOLS

100, 102 shoe upper
10, 11 semi-finished shoe upper (SFSU)
1 upper main body
2 sole cover
2R sole right portion
2L sole left portion
3 instep cover
3R main body right portion
3L main body left portion
4 belt-form knitted fabric
4R right side additional knitted fabric
4L left side additional knitted fabric
5 shoe opening
5*i* foot insertion opening
5*s* slit
5*e* edge portion
6 reinforced knitted fabric
6R right side additional knitted fabric
6L left side additional knitted fabric
7R right side additional knitted fabric
7L left side additional knitted fabric

The invention claimed is:

1. A method for producing a shoe upper including an upper main body configured by a sole cover corresponding to a portion of a sole of a wearer, and an instep cover corresponding to a portion on an instep side of the wearer, the method comprising:

knitting, in a seamless manner, the upper main body configured by the sole cover and the instep cover using a flat knitting machine including at least a pair of a front and a back needle bed, and knitting, in a seamless manner, a right side additional knitted fabric which is connected to a part of an edge portion of a shoe opening in the instep cover by knitting, which part is on a right side of a center line dividing the show opening into right and left, and a left side additional knitted fabric which is connected to a part of the edge portion on a left side of the center line by knitting, to produce a semi-finished shoe upper; and fixing at least one part of the right side additional knitted fabric and at least one part of the left side additional knitted fabric in the semi-finished shoe upper to the upper main body in such a manner that a partial stretch of the upper main body is suppressed by the additional knitted fabrics.

2. The method for producing the shoe upper according to claim 1, wherein upon producing the semi-finished shoe upper, when knitting the semi-finished shoe upper from a sole side toward an instep side, the sole cover is knitted, and thereafter, the instep cover is knitted, and the right side additional knitted fabric and the left side additional knitted fabric are knitted following one part of a terminating end in a wale direction of the instep cover; and when knitting the semi-finished shoe upper from the instep side toward the sole side, the right side additional knitted fabric and the left side additional knitted fabric are knitted, and thereafter, the instep cover is knitted following a terminating end in a wale direction of the additional knitted fabrics, and the sole cover is knitted.

3. The method for producing the shoe upper according to claim 1, wherein upon producing the semi-finished shoe upper, when knitting the semi-finished shoe upper from a heel side toward a toe side, while integrally knitting the sole cover and the instep cover to complete the upper main body, the right side additional knitted fabric and the left side additional knitted fabric are knitted independent from the instep cover and the sole cover, and a terminating end in a wale direction of the right side additional knitted fabric and the left side additional knitted fabric is connected to a position corresponding to the edge portion in the instep cover; and when knitting the semi-finished shoe upper from the toe side toward the heel side, while integrally knitting the sole cover and the instep cover to complete the upper main body, the right side additional knitted fabric and the left side additional knitted fabric are branched from the position of the edge portion in the instep cover.

* * * * *